US008650785B1

(12) United States Patent
Logan et al.

(10) Patent No.: US 8,650,785 B1
(45) Date of Patent: Feb. 18, 2014

(54) SIGN HOLDER ASSEMBLY AND ASSOCIATED METHODS

(71) Applicant: Target Brands, Inc., Minneapolis, MN (US)

(72) Inventors: Robert G. Logan, Blaine, MN (US); Jeremy A. Clark, Minneapolis, MN (US); David H. Cheney, Shoreview, MN (US); Paul A. Schlough, Andover, MN (US); Jason L. Dusbabek, Elk River, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 13/712,649

(22) Filed: Dec. 12, 2012

(51) Int. Cl.
*G09F 3/20* (2006.01)

(52) U.S. Cl.
USPC ..... 40/651; 40/661.03

(58) Field of Classification Search
USPC ..... 211/104; 40/651, 642.02, 661.03, 40/661.02
See application file for complete search history.

(56) References Cited

U.S. PATENT DOCUMENTS

| | | | | |
|---|---|---|---|---|
| 3,313,054 | A | 4/1967 | Madey | |
| 4,698,928 | A | 10/1987 | Soporowski | |
| RE33,443 | E | 11/1990 | Ackeret | |
| 5,042,180 | A | 8/1991 | Horiuchi | |
| 5,605,354 | A | 2/1997 | Kwon | |
| 5,860,537 | A | 1/1999 | Loew | |
| 6,035,569 | A | 3/2000 | Nagel et al. | |
| 6,234,329 | B1 | 5/2001 | Loew | |
| 6,470,611 | B1 | 10/2002 | Conway et al. | |
| 6,553,702 | B1 * | 4/2003 | Bacnik | 40/661.03 |
| 6,568,112 | B2 * | 5/2003 | Lowry et al. | 40/661.03 |
| D476,375 | S | 6/2003 | Zadak et al. | |
| D485,582 | S | 1/2004 | Valiulis | |
| 6,793,185 | B2 | 9/2004 | Joliey | |
| 6,802,146 | B2 | 10/2004 | Gay | |
| D527,426 | S | 8/2006 | Mason | |
| 7,308,770 | B2 | 12/2007 | Fast et al. | |
| D650,019 | S | 12/2011 | Stuke | |
| 2002/0104246 | A1 * | 8/2002 | Reynolds | 40/642.02 |
| 2005/0274052 | A1 * | 12/2005 | Valiulis et al. | 40/661.03 |
| 2006/0053670 | A1 * | 3/2006 | Wiltfang et al. | 40/661.03 |
| 2006/0143962 | A1 * | 7/2006 | Fast et al. | 40/642.02 |
| 2008/0022574 | A1 * | 1/2008 | Alves | 40/661.03 |
| 2008/0282592 | A1 | 11/2008 | Brinkman et al. | |
| 2009/0320344 | A1 * | 12/2009 | Barkdoll et al. | 40/661.03 |

OTHER PUBLICATIONS

Office Action from Canadian Patent Application No. 2,798,624, mailed Mar. 25, 2013 (2 pages).

* cited by examiner

*Primary Examiner* — Shin Kim
(74) *Attorney, Agent, or Firm* — Griffiths & Seaton PLLC; JoAnn M. Seaton

(57) ABSTRACT

A sign holder assembly includes a front enclosure and a rear cover. The front enclosure includes a front plate, two opposing sidewalls, a top wall, and a bottom wall collectively defining a cavity. The front plate defines a front opening. The rear cover includes a rear panel, a top panel, a bottom panel, and a top rail. The top rail extends downwardly from the top panel toward the bottom panel to at least partially define a first top channel configured to slidably maintain an enlarged portion of a sign such that the sign hangs downwardly from the first top channel and extends across the front opening. The rear cover selectively transitions with respect to the front enclosure between a closed configuration and an open configuration.

24 Claims, 11 Drawing Sheets

SIGN HOLDER ASSEMBLY AND ASSOCIATED METHODS

BACKGROUND OF THE INVENTION

Signs are commonly used in retail settings to present information to customers about a promotion and/or a product for purchase. For example, overhead signs are hung over a grouping of display structures including related products and are used to indicate a general location of the products. Upright signs can be positioned adjacent display structures or in aisles between display structures to direct the customer to a product location or to inform the customer of sales or promotions. In other instances, signs are attached directly to the display structures, such as on shelving, to provide identifying and/or price information to the customer.

SUMMARY OF THE INVENTION

One aspect of the present invention relates to sign holder assembly including a front enclosure and a rear cover. The front enclosure includes a front plate, two opposing sidewalls, a top wall, and a bottom wall. The two opposing sidewalls, the top wall, and the bottom wall each extend rearwardly from the front plate to define a cavity therebetween. The front plate defines a front opening formed therethrough. The rear cover includes a rear panel, a top panel, a bottom panel, and a top rail. The top panel and the bottom panel extend forwardly from opposing edges of the rear panel. The top rail extends downwardly from the top panel toward the bottom panel to at least partially define a first top channel configured to slidably maintain an enlarged portion of a sign such that the sign hangs downwardly from the first top channel and extends across the front opening. The rear cover selectively transitions with respect to the front enclosure between a closed configuration, in which the rear cover extends between the two opposing sidewalls, the top wall, and the bottom wall of the front enclosure to cover the cavity, and an open configuration, in which the rear cover is spaced from the two opposing sidewalls, the top wall, and the bottom wall of the front enclosure. Other sign holders, assemblies, and methods are also disclosed.

BRIEF DESCRIPTION OF THE DRAWINGS

Embodiments of the invention will be described with respect to the figures, in which like reference numerals denote like elements, and in which.

DETAILED DESCRIPTION

A sign holder assembly is provided for holding a tablet sign (e.g., a sign including a plurality of pages spirally bound together along a first edge) or other sign item for display on a product display shelf, for example, in a retail setting. In one embodiment, the sign holder assembly includes a rectangular, open box section defining an internal cavity and attached to a rear panel or closure section. The open box section includes a windowed or open front panel and sidewalls extending from the front pane to define the internal cavity therebetween. The closure section is rotatable along one edge of the sidewalls of the open box section to thereby form a closed box configuration or an open box configuration. The closure section includes a channel or track extending along its top wall, which selectively retains a portion of the tablet sign, for example, a spiral binding of the tablet sign, such that a selected page of the tablet sign can be viewed through the front panel.

In one example, a rear surface of the rear panel of the sign holder includes flanges for slidably receiving a front portion of a flexible mount adapter. The flexible mount adapter is mounted to the product display shelf opposite the sign holder such that the sign holder assembly extends out in front of the product display shelf. The flexible mount adapter includes a living hinge allowing the sign holder to flex or move when bumped or otherwise interfered with by a retail store employee or customer rather than inadvertently becoming entirely or partially decoupled from the product display shelf. In one embodiment, the living hinge allows the sign holder assembly to be flipped up and over the product display shelf as desired (e.g., to access products otherwise partially hidden behind the sign holder assembly) and is biased to rotate back down to once again extend in front of the product display shelf when desired.

Figure 1:
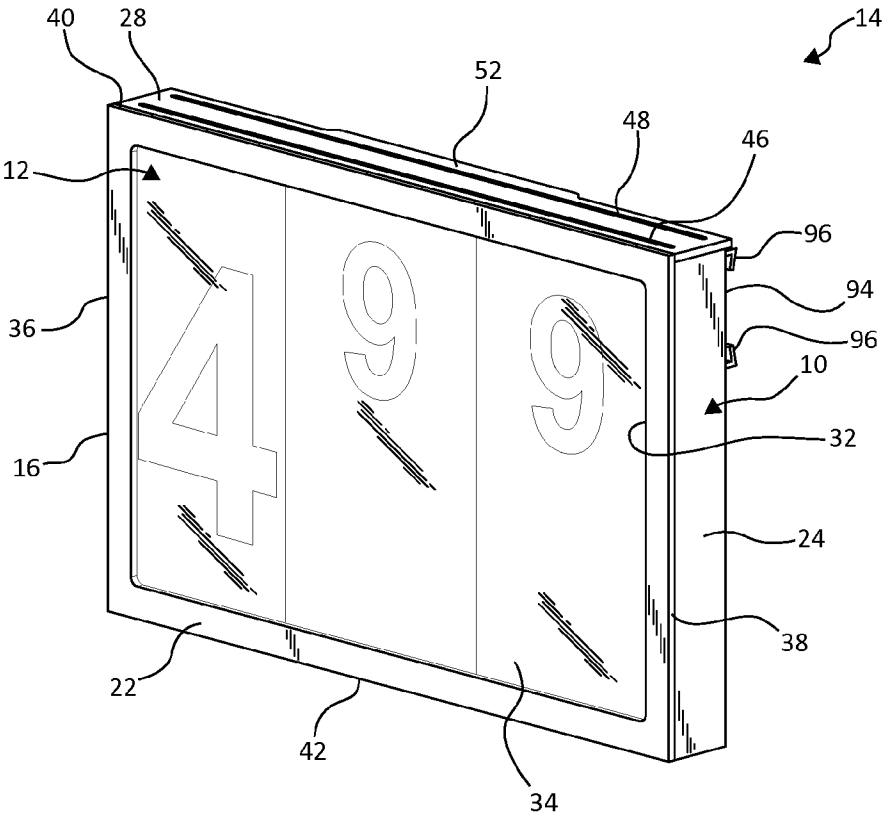
FIG. 1 is a front, perspective view illustration of a sign holder assembly, according to one embodiment of the present invention.
Figure 7:
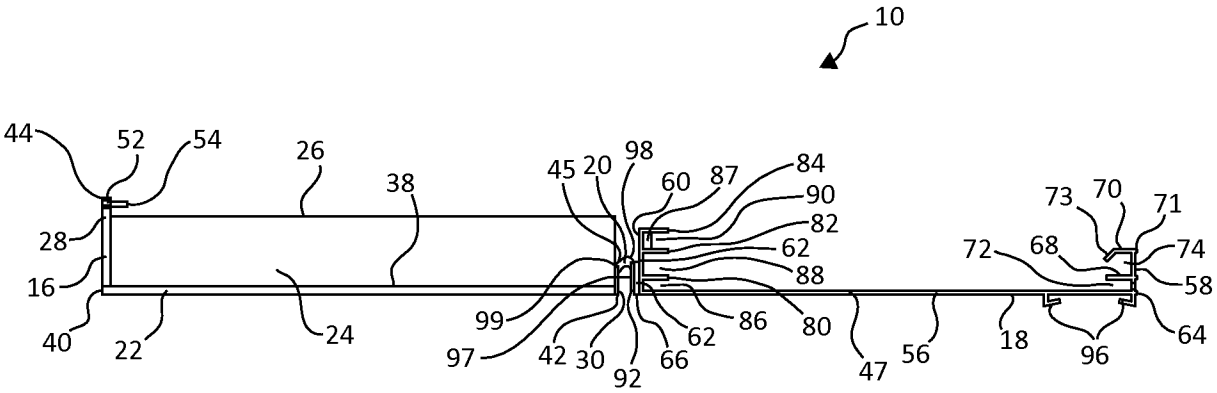
FIG. 7 is a right side view illustration of a sign holder, which is included in the sign holder assembly of FIG. 1, in an open configuration, according to one embodiment of the present invention.

FIGS. 1-7 provide various views of an embodiment of a sign holder 10. Sign holder 10 serves as a frame or an enclosure for containing a tablet sign 12 (generally indicated in FIGS. 1 and 2 through window 32, but more clearly illustrated in FIGS. 8 and 9) or other display items as part of a display assembly 14. Sign holder 10 includes a front or open box section 16 and a rear or closure section 18 attached to open box section 16 via a flexible binding panel 20 or other hinge member. In one embodiment, closure section 18 is configured to rotate relative to open box section 16 to selectively open and close sign holder 10 providing selective access to a cavity 23 defined by open box section 16. When in a first or fully opened configuration, sign holder 10 lies substantially flat as illustrated in FIG. 7. When in a closed configuration, sign holder 10 forms a generally rectangular box as illustrated in FIG. 1.

In one embodiment, open box section 16 (i.e., a front enclosure) is a unitary component and is formed from plastic, metal, or another suitable material. Open box section 16 includes a front plate 22, two opposing sidewalls 24, a top wall 28, and a bottom wall 30. Sidewalls 24, top wall 28, and bottom wall 30 extend rearwardly from front plate 22 to define a cavity 23 on one side of front plate 22. More specifically, each of the two opposing sidewalls 24 extends from and between opposite ends of top wall 28 and bottom wall 30.

Figure 2:
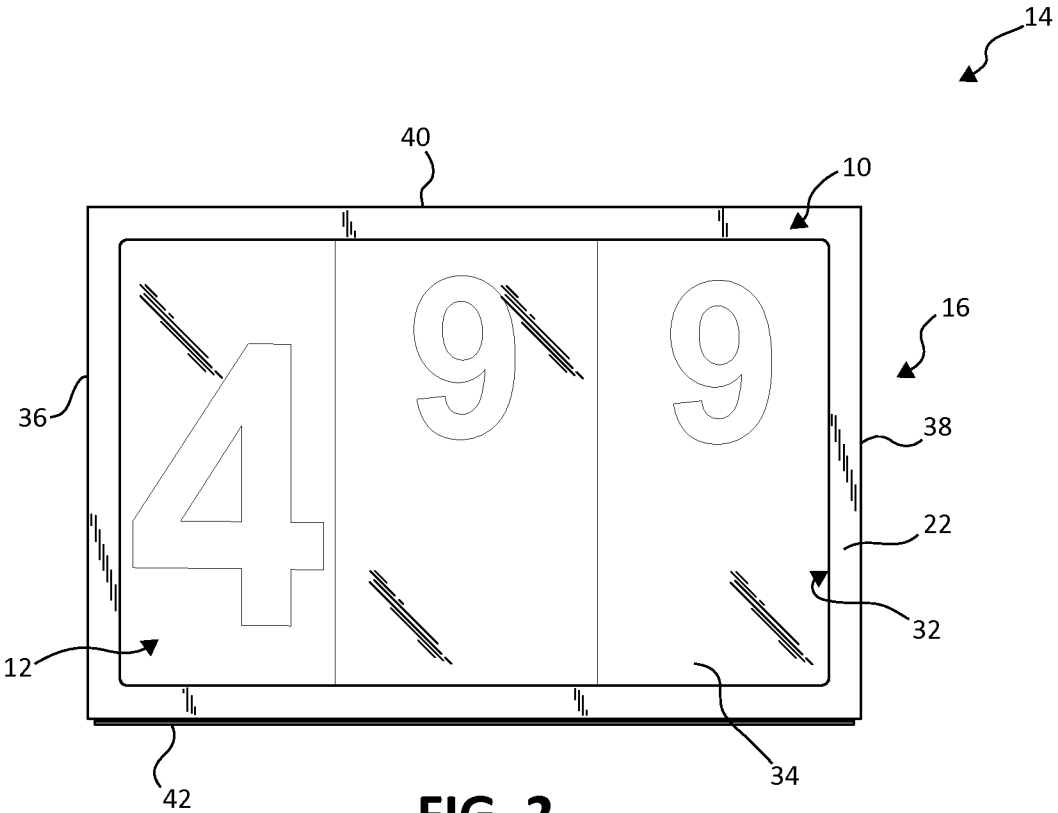
FIG. 2 is front view illustration of the sign holder assembly of FIG. 1, according to one embodiment of the present invention.
Figure 3:
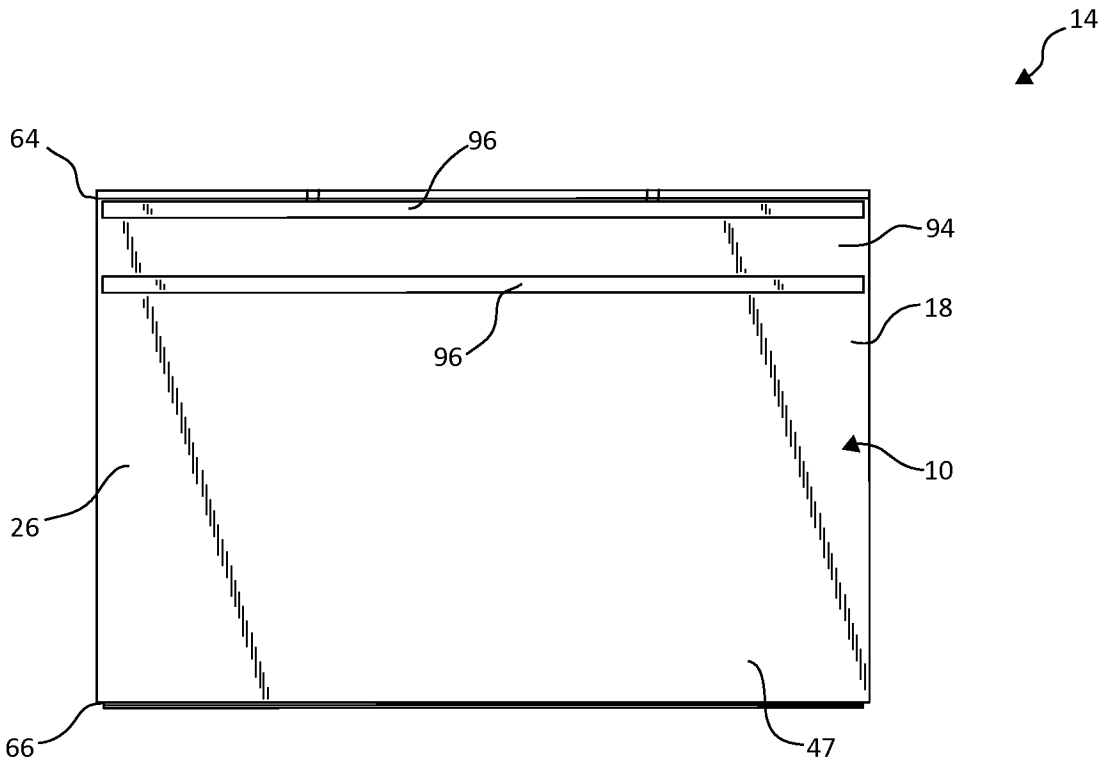
FIG. 3 is a rear view illustration of the sign holder assembly of FIG. 1, according to one embodiment of the present invention.
Figure 4:
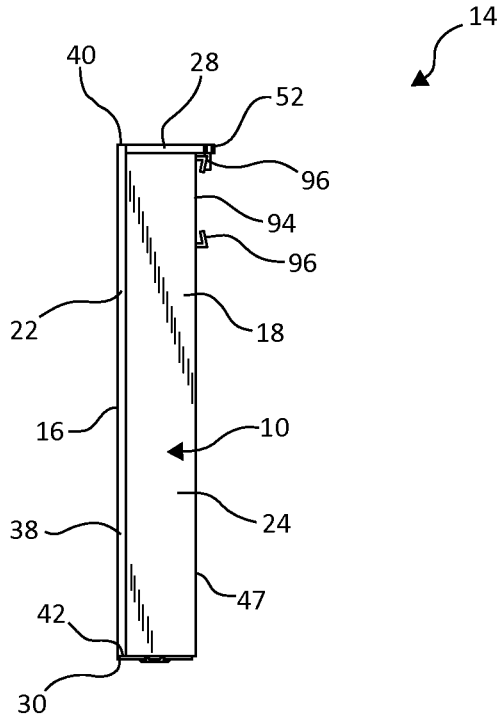
FIG. 4 is a right side view illustration of the sign holder assembly of FIG. 1, the left side view being a mirror image of the right side view, according to one embodiment of the present invention.
Figure 5:
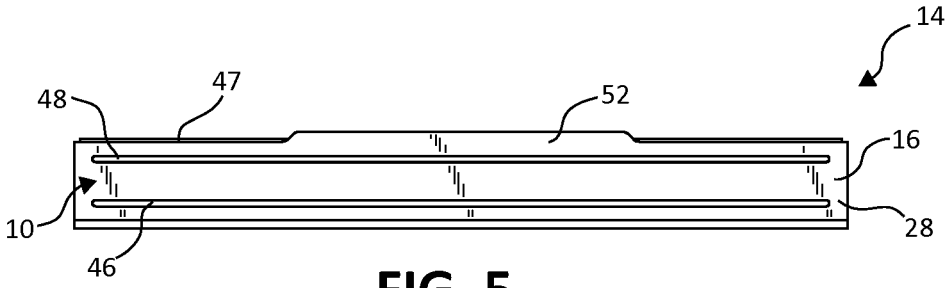
FIG. 5 is a top view illustration of the sign holder assembly of FIG. 1, according to one embodiment of the present invention.
Figure 6:
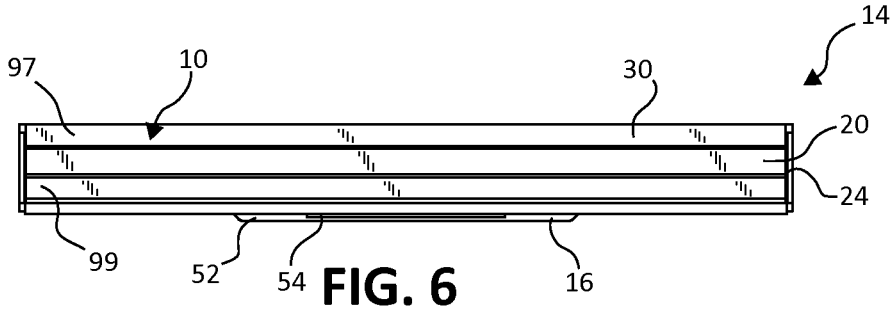
FIG. 6 is a bottom view of the sign holder assembly of FIG. 1, according to one embodiment of the present invention.
Figure 9:
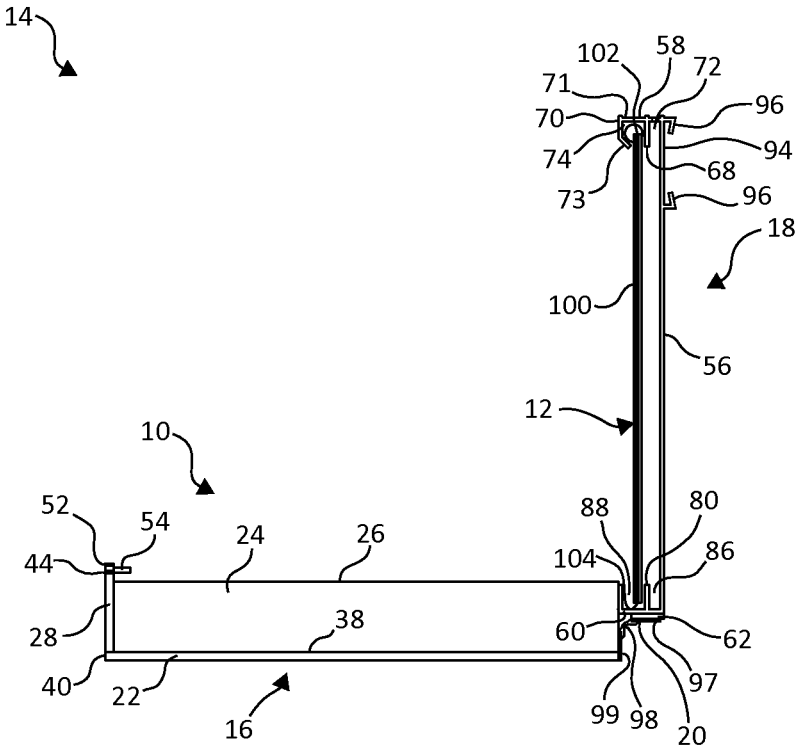
FIG. 9 is a right side view illustration of the partially assembled sign holder assembly of FIG. 8, according to one embodiment of the present invention.

Front plate 22 defines a large, open window 32 configured to provide sight lines into cavity 23 for viewing any item maintained therein, for example, tablet sign 12 (see FIGS. 1, 2, and 9). In one example, window 32 is covered with a substantially transparent panel 34 to protect the display item from damage, tampering, or soiling. Substantially transparent panel 34 extends over an entirety of window 32 and is attached, for example, via an adhesive, laminating process, or other coupling mechanism. Although illustrated as being attached to an internal or rear surface of front panel 22, alternatively, substantially transparent panel 34 is adhered to a front surface of front panel 22. Substantially transparent panel 34 is transparent, translucent, clear, colored, semi-opaque, or otherwise configured to allow a viewer to view the display item contained within open box section 16. Suitable materials for forming substantially transparent panel 34 include, but are not limited to glass, plastic, and the like.

Sidewalls 24 extend from opposing side edges 36 and 38 of front panel 22, and top and bottom walls 28 and 30 extend from opposing top edge 40 and bottom edge 42 of front panel 22. As illustrated, sidewalls 24 extend between top wall 28 and bottom wall 30 and are configured substantially identically to each other. Each sidewall 24 defines a free edge 26 opposite front panel 22, and top wall 28 defines a free edge 44 opposite front panel 22. In one example, free edges 26 of sidewalls 24 are spaced a first distance from front panel 22 that is less than a second distance a free edge 44 of top wall 28 is positioned from front panel 22. Bottom wall 30 defines a free edge 45 opposite front panel 22. As shown in the illustrated embodiments, free edge 45 of bottom wall 30 is positioned a third distance from front panel 22 that is less than each of the first distance and the second distance. The third distance, which represents a depth of bottom wall 30, is about one third of the first distance, which represents a depth of sidewalls 24, according to one example of the invention.

Top wall 28 includes a forward slot 46 and a rear slot 48, each extending substantially parallel to top edge 40 of front panel 22 and, in one embodiment, configured to contribute to holding sign holder 10 in a closed position as will be further described below. Forward slot 46 is formed along substantially an entire length of top wall 28 and is adjacent top edge 40 of front panel 22. Rear slot 48 is spaced apart from forward slot 46 a predetermined distance and extends adjacent free edge 44. To maintain closure section 18 in position relative to open box section 16 when sign holder 10 is in the closed configuration, top wall 28 also includes a tab 52 and a catch 54 extending from tab 52. In particular, tab 52 extends rearwardly a small distance from approximately a middle of free edge 44 of top wall 28, and catch 54 extends downwardly and is configured to facilitate selective maintenance of sign holder 10 in a closed position.

Figure 8:
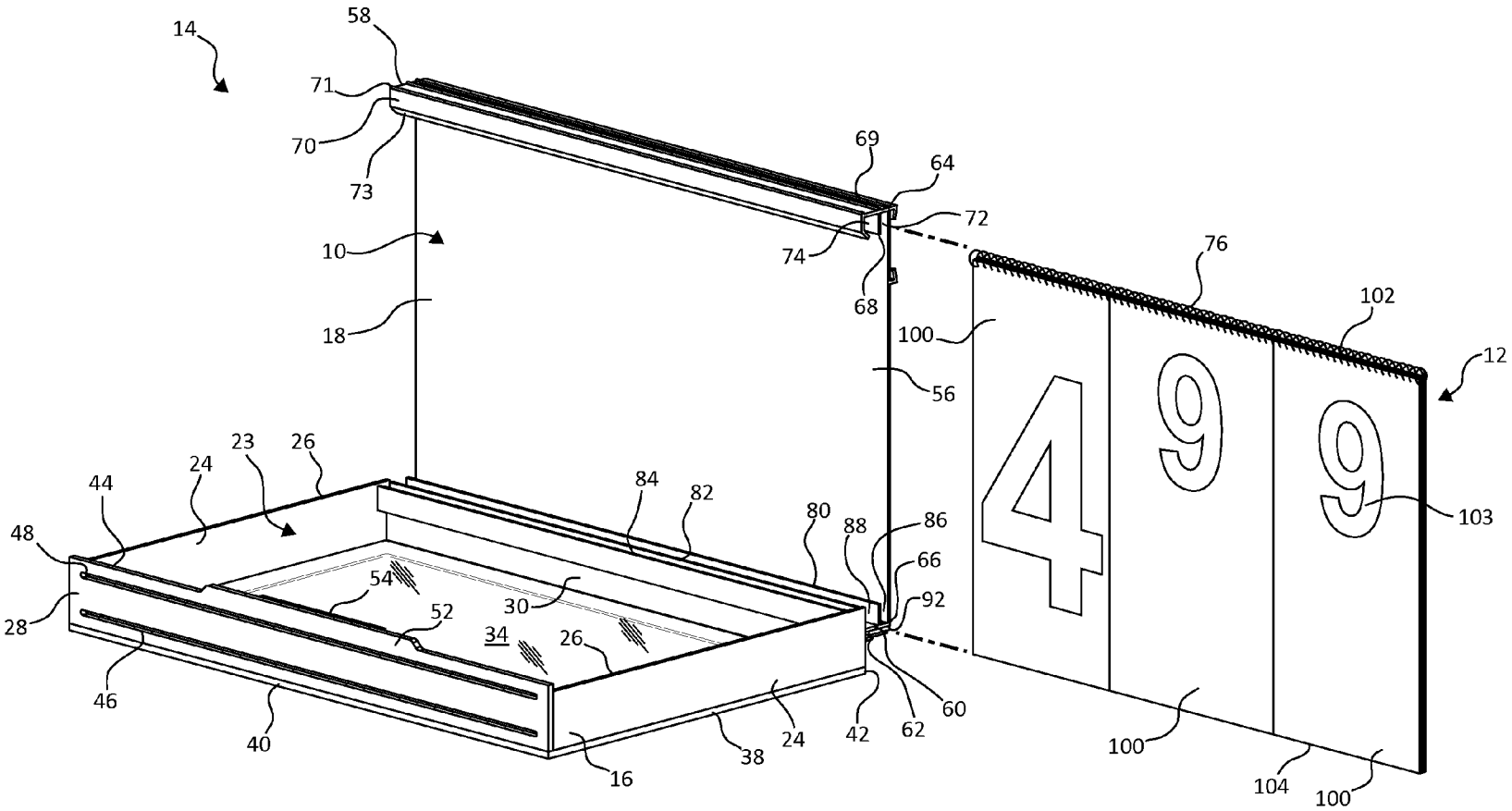
FIG. 8 is an exploded view illustration of a partially assembled sign holder assembly, according to one embodiment of the present invention.

With additional reference to FIGS. 7-9, closure section 18 (i.e., a cover) is a unitary component formed of substantially the same material as open box section 16, for example, formed as a single piece with open box section 16. In an example, closure section 18 is formed of plastic, metal, or another robust material. Closure section 18 includes a rear panel 56, a top or binder reception panel 58, and a bottom panel 60. Rear panel 56 is substantially planar and is configured to be slightly smaller than front panel 22 such that closure section 18 ultimately fits within cavity 23 of open box section 16, as will be further described below. Rear panel 56 defines a top edge 64 from which binder reception panel 58 extends, for example, with a substantially perpendicular orientation relative to rear panel 56. Rear panel 56 also defines a bottom edge 66 from which bottom panel 60 extends, for example, with a substantially perpendicular orientation relative to rear panel 56. At least binder reception panel 58 is configured to retain display items within sign holder 10.

For example, closure section 18 includes two rails 68 and 70 extending from an interior surface of binder reception panel 58 toward bottom panel 60, and binder reception panel 58 defines a rear slot 69. Rails 68 and 70 each extend along a substantial entirety of a width of binder reception panel 58 extend downwardly from binder reception panel 58 to define two channels 72 and 74 for retaining planar items to be displayed. In particular, rail 68 extends substantially perpendicular relative to binder reception panel 58, which, in one example, is substantially parallel to rear panel 56. Rail 68 is spaced apart from rear panel 56, e.g., more inwardly or forwardly positioned relative to rear panel 56, to define first channel 72 between rail 68 and rear panel 56. To provide access to first channel 72, rear slot 69 is formed at a location along binder reception panel 58 between rear panel 56 and rail 68. More particularly, rear slot 69 aligns with rear slot 48 of open box section 16 to allow insertion of a display item, such as tablet sign 12, into cavity 23 when sign holder 10 is in the closed configuration. In this regard, in one example, rear slot 69 extends substantially an entirety of the length of binder reception panel 58 and has a length that is substantially equal to or similar to that of rear slot 48.

Binder reception panel 58 defines a free edge 71 opposite rear panel 56. Rail 70 initially extends from binder reception panel 58 in a direction substantially parallel to rail 68 downwardly from free edge 71 to form second channel 74. In an embodiment, rail 70 includes a ledge 73 opposite rear panel 56 that angles toward rail 68 so that an bottommost portion of second channel 74, that is, a portion farthest from binder reception panel 58, is narrower than a topmost portion of second channel 74. In one example, ledge 73 is biased to extend toward rear panel 56, but allows for some flexing to receive a portion of tablet sign 12 to hang tablet sign 12 therefrom as will be further described below. Although channel 74 is illustrated as being wider than channel 72, channel 72 is wider than channel 74 or both are substantially equal in width in other embodiments.

Closure section 18 additionally includes rails 80, 82, and 84 extending upwardly from bottom panel 60 toward binder reception panel 58. Rails 80, 82, and 84 at least partially form bottom channels 86, 88, and 90. More particularly, bottom channel 86 is defined between rear panel 56 and rail 80, which is positioned a similar distance away from rear panel 56 as rail 68. In this manner, bottom channel 86 substantially aligns with channel 72. Rail 82 is spaced forwardly from rail 80 to define bottom channel 88 therebetween in a manner substantially aligning with channel 74. Rail 84 is spaced forwardly from rail 82 to define bottom channel 90 therebetween. In one example, each of rails 80, 82, and 84 extends a substantial entirety of a width of bottom panel 60. In an example, rails 80 and 68 lie in substantially the same plane, and rails 82 and 70 lie in substantially the same plane. Rails 80, 82, and 84 extend substantially perpendicularly relative to bottom panel 60 along a length thereof and are substantially evenly spaced along a width of panel 60, in one embodiment. As illustrated, each of rails 80, 82, and 84 is substantially identical in height. Alternatively, rails 80, 82, and/or 84 are unevenly spaced along width of panel 60 and/or vary in height.

In an embodiment, an insert 87 is included at a bottom of channel 90 to support an edge of a display item (not shown) retained therein. Insert 87 extends along substantially an entirety of the length of channel 90 and has a desired thickness selected so that when the item to be retained is held vertically between channel 90 and top wall 28, a shortest distance therebetween is slightly greater than the height of the item. Insert 87 is permanently attached to bottom panel 60 via an adhesive or fastener or is simply placed over bottom panel 60 without adherence thereto in s non-permanent manner. In one embodiment, insert 87 is eliminated.

Closure section 18 includes a track 94 defined between two opposing flanges 96 each extending rearwardly from rear surface 47 of rear panel 56. In one example, each of the two opposing flanges 96 is substantially L-shaped and open toward one another to define track 94 between rear surface 47 and each of flanges 96. As illustrated, the two opposing flanges 96 and track 94 are formed near reception panel 58, for example, at a top one of the two opposing flanges 96 extending from an edge of rear surface 47 adjacent reception panel 58. Track 94 facilitates coupling of sign holder 10 with a display structure as will be further described below.

An optional attachment strip 62 extends along a substantial entirety of a length of bottom panel 60 and is aligned therewith along a rear edge 92 thereof. Attachment strip 62 is included to cooperate with bottom wall 30 of open box section 16 to collectively define a bottom surface of sign holder 10 when sign holder 10 is in the closed configuration. In one example, attachment strip 62 is approximately three-quarters of the height of bottom wall 30 of open box section 16 and is substantially equal in thickness thereto.

Flexible binding panel 20 attaches to attachment strip 62 (or bottom panel 60, if attachment strip 62 is omitted) and an outer surface of bottom wall 30 to thereby hingedly couple closure section 18 to open box section 16. In one example, attachment strip 62, flexible binding panel 20, and bottom wall 30 are formed of a single piece of material. Flexible binding panel 20 is formed from an elastomeric material, such as rubber, plastic, or another flexible material and is of a suitable thickness to serve as a living hinge allowing for ready flexing of bottom wall 30 relative to bottom panel 60. In an embodiment, flexible binding panel 20 is divided into two elongated halves along a hinge portion 98, where a first half 97 of flexible binding panel 20 is attached to attachment strip 62 while a second half 99 of flexible binding panel 20 is attached to bottom wall 30. Hinge portion 98 is slightly thinner than surrounding portions of flexible binding panel 20 to improve rotational motion when closure section 18 is rotated relative to open box section 16, according to one embodiment.

In one embodiment, tablet sign 12 is provided for use with sign holder 10. Tablet sign 12 may take on any one of a plurality of configurations as will be apparent to those of skill in the art upon reading the present application. In one example, tablet sign 12 is formed of a plurality of flaps or pages 100 bound together along one edge 102 via a binding 76, such as a spiral binding. According, each one of pages 100 can be flipped or rotated about binding 76 to reveal a different one of pages 100 with different indicia 103 included thereon. For instance, each page 100 includes indicia 103 such as numbers to indicate pricing or letters to spell different words. Each page 100 extends along an entire length of binding 76 or is shorter than binding 76 such that stacks of the plurality of pages 100 fit edge to edge along the length of binding 76. Although binding 76 is illustrated as a spiral binding, binding 76 can take on a variety of forms and/or be a clip or other coupling mechanism for binding pages in alternate embodiments as will be apparent to those of ordinary skill after reading this application.

Turning to FIGS. 8 and 9, during use, sign holder 10 is placed in the open position (e.g., FIG. 8) to receive tablet sign 12 or other display item. For example, closure section 18 is rotated to a position that is substantially perpendicular relative to open box section 16 as illustrated in FIG. 8. Alternatively, closure section 18 is rotated so that both closure section 18 and open box section 16 lay substantially flat (e.g., substantially coplanar with one another) on a planar surface, e.g., as illustrated in FIG. 7. Tablet sign 12, in particular, binding 76, is slid or otherwise suitably inserted into channel 74. In one embodiment, binding 76 is thicker than the collective thickness of pages 100 such that binding 76 is held tightly within channel 74 largely via interaction with angled ledge 73. In an embodiment in which tablet sign 12 is sufficiently wide, a bottom edge 104 of tablet sign 12 opposite binding 76 is slid into bottom channel 88. While sign holder 10 is in the open configuration, other display items such as planar signs (not shown) may be placed in other locations, such as to extend between channel 72 and bottom channel 86.

After tablet sign 12 is appropriately positioned within channel 74 and/or bottom channel 88, closure section 18 is rotated along hinge portion 98 to close sign holder 10. More particularly, closure section 18 is rotated along hinge portion 98 to mate with open box section 16, for example, to fit within cavity 23 formed by open box section 16 to place sign holder 10 in the closed configuration. Slight outward pressure is applied to an interior facing surface 106 of top wall 28, and more particularly, tab 52, to allow closure section 18 to be positioned just inside of catch 54 to selectively hold sign holder 10 in the closed configuration. The inclusion of forward and rear slots 46 and 48 allow top wall 28 to be temporarily slightly deformed when pressure is applied thereto so that tab 52, and hence catch 54, can be repositioned upwardly before closure section 18 is placed into cavity 23 and then released to an original position after closure section 18 is disposed inside catch 54. Although depicted as a substantially rectangular strip, catch 54 has other configurations, such as a hook, semicircle or other shape in other embodiments. When sign holder 10 is closed, in one example, a rear surface 47 of rear panel 56 of closure section 18 lays flush with free edges 36 of open box section 16 presenting an overall appearance of a clean-lined rectangular box.

In one embodiment, when sign holder 10 is in the closed configuration with or without tablet sign 12, a different display board or other planar display item (not shown) is inserted into forward slot 46 or rear slot 48 and a bottom edge of the item is retained in corresponding bottom channel 86 or 90. Notably, when sign holder 10 is in the closed configuration, rail 70 of closure section 18 together with front panel 22 and top wall 28 of open box section 16 form a third channel (not shown), which is accessible via front slot 46 formed on top wall 28. In this way, a planar item (not shown) can be inserted through front slot 46 to at least partially block viewing of tablet sign 12 through window 32 when tablet sign 12 is still in cavity 23.

During continued use of sign holder 10, sign holder 10 can repeatedly be opened and closed to allow signs, such as tablet sign 12, to be adjusted (e.g., pages flipped to indicate a desired price and/or other message), removed, or inserted into sign holder 10. When sign holder 10 is closed, open box section 16 serves as a frame for tablet sign 12 or other signs and/or conceals binding 76 of tablet sign 10 providing a more upscale and aesthetically pleasing appearance than when binding 76 and outer edges of tablet sign 12 or other signs are exposed.

Figure 10:
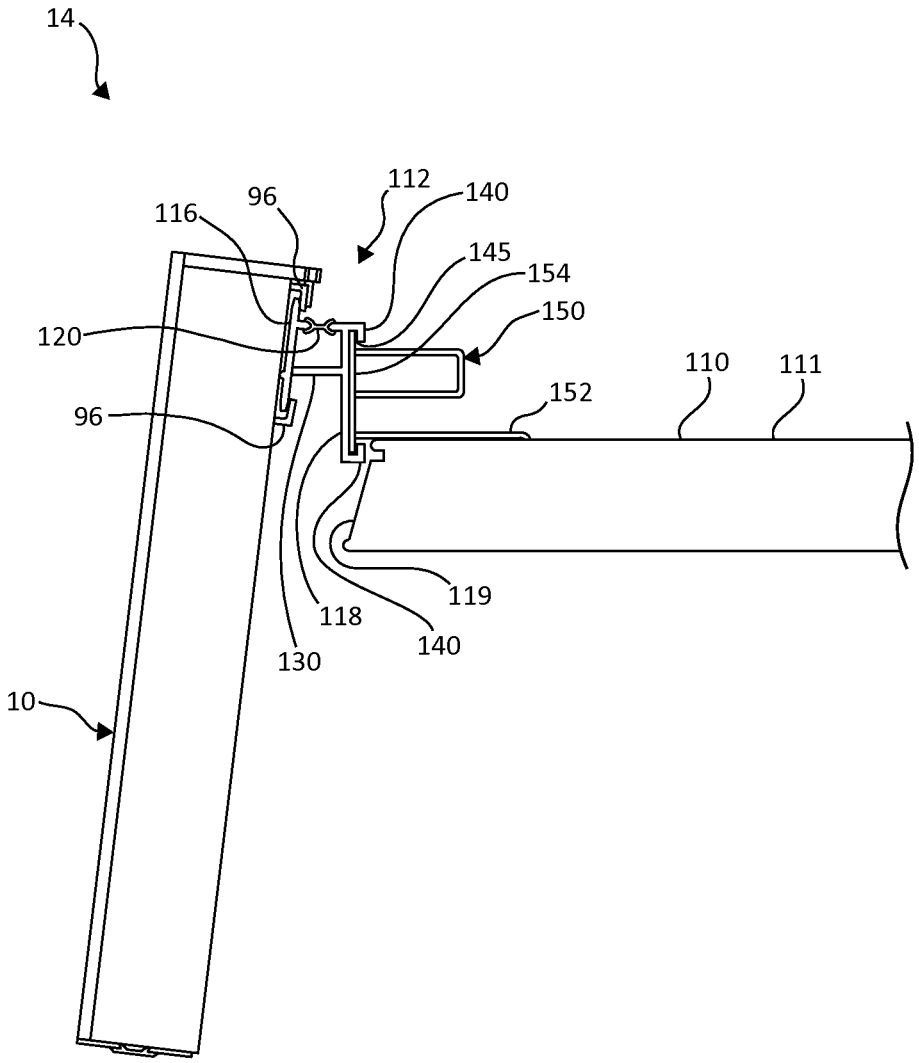
FIG. 10 is a right side view illustration of the sign holder assembly of FIG. 1 attached to a display shelf via a bracket with the sign holder assembly and the bracket being in a first position, according to one embodiment of the present invention.
Figure 11:
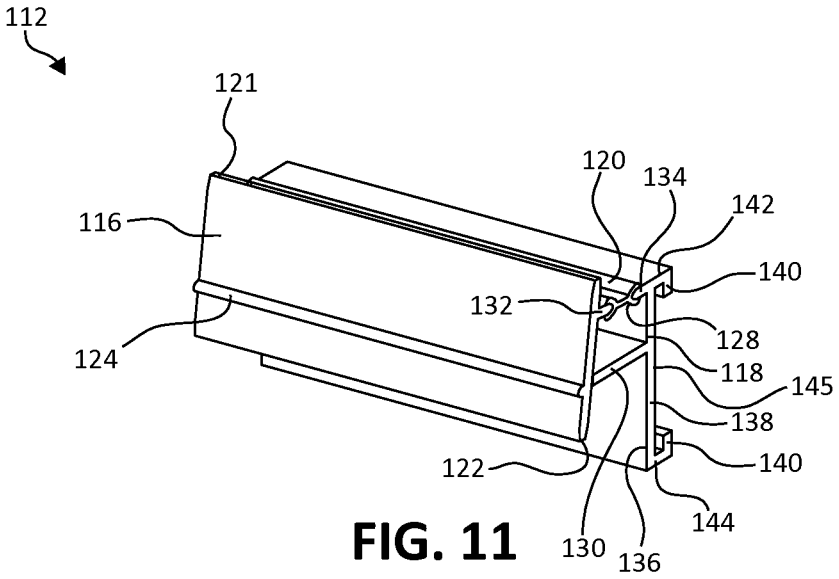
FIG. 11 is a perspective view illustration of the bracket of FIG. 10, according to one embodiment of the present invention.
Figure 12:
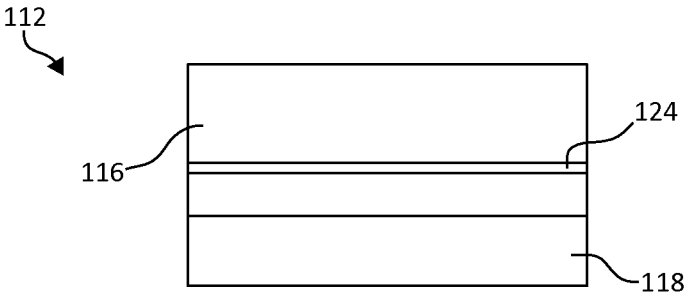
FIG. 12 is a front view illustration of the bracket of FIG. 11, according to one embodiment of the present invention.
Figure 13:
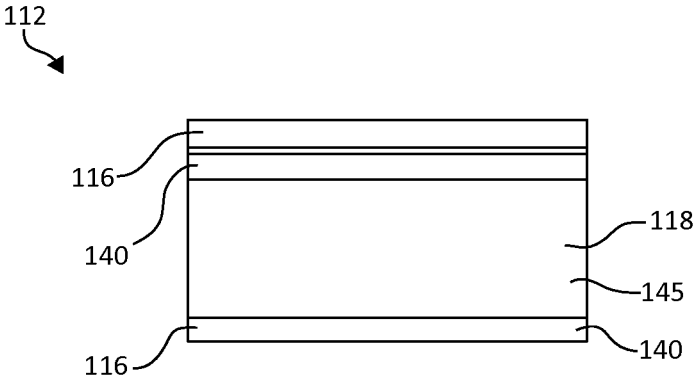
FIG. 13 is rear view illustration of the bracket of FIG. 11, according to one embodiment of the present invention.
Figure 14:
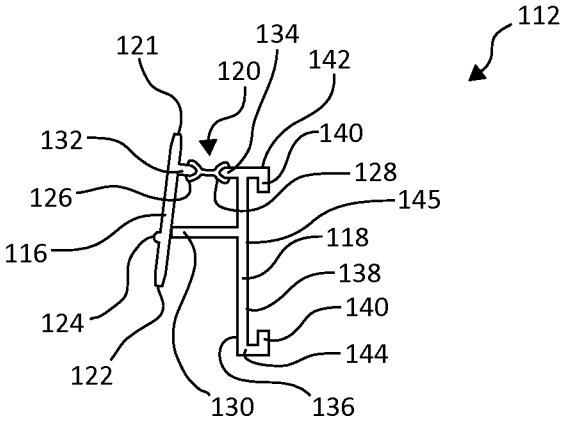
FIG. 14 is a right side view illustration of the bracket of FIG. 11, the left side view being a mirror image of the right side view, according to one embodiment of the present invention.
Figure 15:
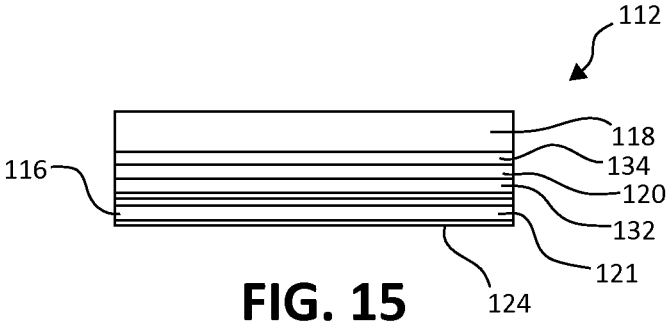
FIG. 15 is a top view illustration of the bracket of FIG. 11, according to one embodiment of the present invention.
Figure 16:
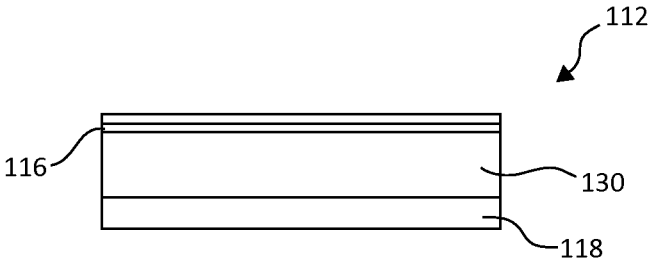
FIG. 16 is a bottom view illustration of the bracket of FIG. 11, according to one embodiment of the present invention.

With additional reference to FIG. 10, in one embodiment, sign holder 10 is coupled to a product display shelf 110 to hang from and/or extend outwardly in front of product display shelf 110 and display sign information relating to any products (not shown) supported on product display shelf 110. In one example, sign holder 10 is mounted to product display shelf 110 via a flexible mount adapter or mounting bracket 112, which is received in track 94 formed between flanges 96 of sign holder 10.

FIGS. 11-17 illustrate various views of one embodiment of mounting bracket 112. Mounting bracket 112 includes a holder attachment section 116, a shelf attachment section 118, and a flexible hinge 120 extending between holder attachment section 116 and shelf attachment section 118 and, in one embodiment, is formed as a single unitary component entirely formed of an elastomeric or otherwise flexible material, such as rubber, plastic, and the like. Holder attachment section 116 is configured to interface with sign holder 10, shelf attachment section 118 is configured to selectively couple with product display shelf 110, and flexible hinge 120 is configured to allow holder attachment section 116 to rotate and/or flip up relative to shelf attachment section 118.

As shown, holder attachment section 116 is substantially planar and generally rectangular or square and defines a top edge 121 and a bottom edge 122 opposite top edge 121. Mounting bracket 112 includes a horizontal projection 124 extending outwardly (i.e., away from shelf attachment section 118) from holder attachment section 116 spaced above bottom edge 122. Alternatively, horizontal projection 124 is otherwise formed in between top and bottom edges 121 and 122 or closer to top edge 121 or is eliminated. Although shown as a long, curved bump, horizontal projection 124 is a series of projections or has a square or rectangular lateral cross section in alternate embodiments.

Flexible joint or hinge 120 extends rearwardly from holder attachment section 116, for example, along a top portion thereof just below top edge 121. Mounting bracket 112 includes a holder attachment projection 132 extending rearwardly from holder attachment section 116 just below top edge 121 to couple to hinge 120. Hinge 120 extends rearwardly from holder attachment projection 120 to a shelf attachment projection 134 extending forwardly from shelf attachment section 118. In one example, hinge 120 includes two reinforced, bulbous portions 126 at outer extremities thereof and a thin portion 128 extending between the two reinforced, bulbous portions. Thin portion 128 allows holder attachment section 116 to flex, bend, or otherwise rotate relative to shelf attachment section 118.

Shelf attachment section 118 is substantially planar and, in one example, substantially vertically extending. Shelf attachment projection 134 is positioned near a top of shelf attachment section 118 and extends to meet hinge 120, as described above. In one embodiment, mounting bracket 112 includes a spacer projection 130 extending forwardly from the front surface 136 of shelf attachment section 118 below shelf attachment projection 134. Spacer projection 130 is deeper front to back than the combined depth of holder attachment projection 132, hinge 120, and shelf attachment projection 134 and is positioned to selectively interact with a rear surface of holder attachment section 116. Accordingly, spacer projection 130 maintains holder attachment section 116 spaced from shelf attachment section 118. In one example, since spacer projection 130 is deeper than the collective depth of holder attachment projection 132, hinge 120, and shelf attachment projection 134, spacer projection 130 maintains holder attachment section 116 at a a desired angle relative to shelf attachment section 118, e.g., at an angle within about 45 degrees of vertical). When holder attachment section 116 is flipped up about or otherwise rotated about hinge 120, holder attachment section 116 is selectively moved out of interaction with spacer projection 130, but is biased to return back to interaction with spacer projection 130 when the flipping or rotating force is removed.

In one example, mounting bracket 112 includes a pair of hook flanges or rails 140 extending rearwardly from rear surface 138 of shelf attachment section 118, more specifically, a top edge 142 and a bottom edge 144 of shelf attachment section 118. A shelf track 145 is defined between rails 140 and is configured to receive a corresponding portion of product display shelf 110 or a bracket 150 or other component coupled thereto (FIGS. 10 and 17).

Figure 17:
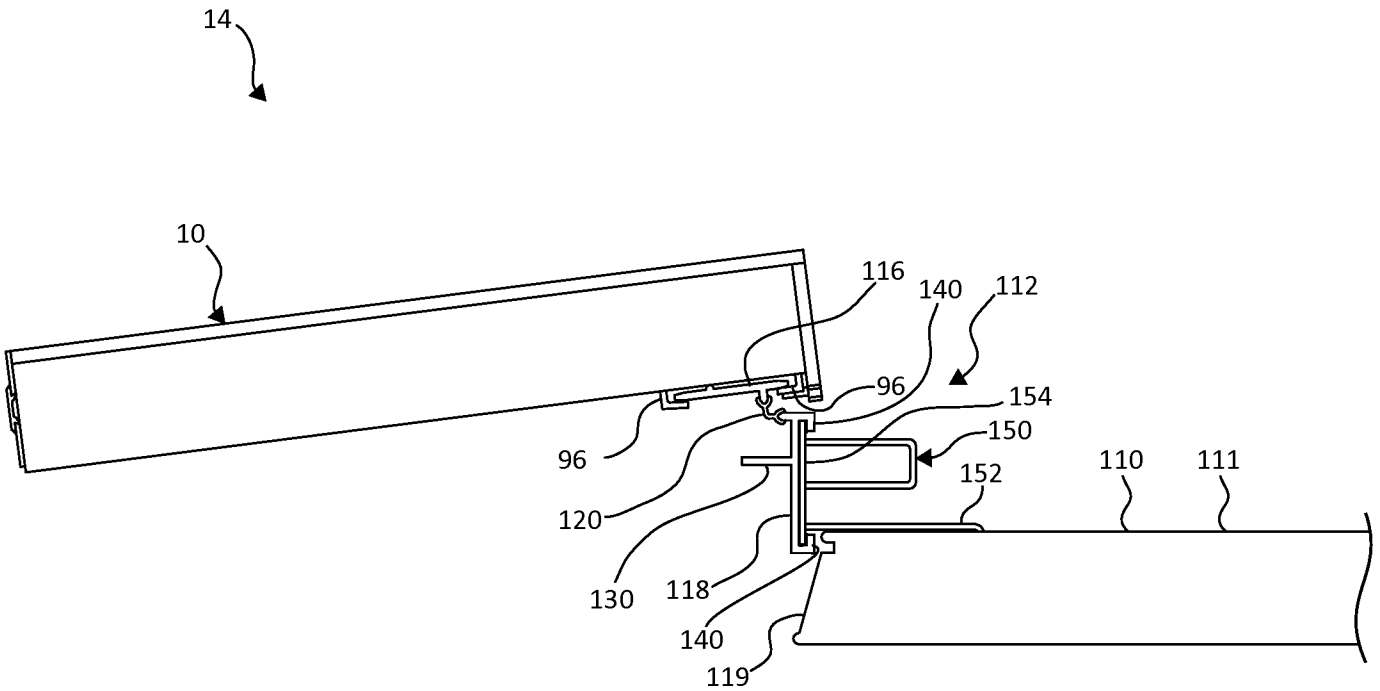
FIG. 17 is a right side view illustration of the sign holder assembly, the display shelf, and the bracket of FIG. 10 with the bracket and sign holder assembly in a second position, according to one embodiment of the present invention.

For example, one embodiment of product display shelf 110 is illustrated in FIGS. 10 and 17. Product display shelf 110 forms a product support surface 111 that is substantially planar and, in one embodiment, orientated substantially horizontally. Product display shelf 110 includes a front edge or front panel 119 extending along a front most portion of product support surface 111 to extend in a substantially vertical (e.g., within about 40 degrees of vertical) plane. In one example, front panel 119 is substantially planar and square or otherwise rectangular in shape.

In one embodiment, an auxiliary bracket 150 is coupled to product display shelf 110 to facilitate coupling mounting bracket 112 with product display shelf 110. Auxiliary bracket 150 includes a shelf coupling panel 152 and an interface panel 154 extending substantially perpendicular and largely upwardly from shelf coupling panel 152, which is rigidly coupled thereto. Shelf coupling panel 152 includes prongs (not shown) configured to be selectively received in mounting apertures (not shown) near front panel 119 of product display shelf 110, according to one embodiment. Interface panel 154 is substantially planar and substantially square or rectangular per embodiments of the innovation. In one embodiment, auxiliary bracket 150 is eliminated and/or mounting bracket 112 is modified or replaced to directly couple with product display shelf 110 as sill be apparent to those of skill in the art upon reading the currently application.

During assembly of the display assembly 14, mounting bracket 112 is coupled with each of sign holder 10 and front panel 119 of product display shelf 110 in no particular order. For example, sign attachment section 118 of mounting bracket 112 is slid into track 94 of sign holder 10 and maintained between opposing tracks 96. Auxiliary bracket 150 is coupled with product display shelf 110 to, for example, extend slightly in front of front panel 119 of product display shelf 110. For example, interface panel 154 of auxiliary bracket 150 is positioned in front of front panel 110. Subsequently, interface panel 154 is slid into track 145 of mounting bracket 112 and maintained between flanges 140. As a result, mounting bracket 112 spaces sign holder 10 from product display shelf 110 and indirectly couples mounting bracket 112 to product display shelf 110. Shelf attachment section 118, which is adjacent interface panel 154, serves as a stationary plate or component maintaining sign holder 10 at a desired angle relative to product display shelf 110 for easier viewing of tablet sign 12 or other planar display items contained therein.

According to an embodiment, holder attachment section 116 is configured to rotate about hinge 120 so that it lies in substantially the same or in a parallel plane relative to product display shelf 110 (FIG. 17). For example, thin portion 128 is formed such that hinge 120 is capable of allowing mounting bracket 112 to fold about in half, or for mounting bracket 112 to be bent at hinge 120 so that holder attachment section 116 is substantially perpendicular relative to shelf attachment section 118. In another embodiment, front panel 119 of product display shelf 110 is suitably formed to be directly received within track 94 of sign holder 10 and mounting bracket 112 is eliminated.

By configuring sign holder 10 as a box, tablet signs 12 or other planar display items are contained within an aesthetically pleasing, clean-lined receptacle and protected from potential soiling, damage, or tampering. Consequently, tablet signs 12 or planar display items can be re-used many times, which reduces costs. Mounting sign holder 10 to product display shelf 110 using flexible mounting bracket 112 improves the customer-friendliness of the retail setting by preventing decoupling of sign holder 10 with product display shelf 110 and allowing movement of sign holder 10 relative to product display shelf 110 when bumped or otherwise interfered with by a retail store employee or the customer. Mounting bracket 112 also allows sign holder 10 to be deliberately flipped up to provide ready access to products, etc. behind sign holder 10.

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. A sign holder assembly comprising:

a front enclosure including a front plate, two opposing sidewalls, a top wall, and a bottom wall, wherein:

the two opposing sidewalls, the top wall, and the bottom wall each extend rearwardly from the front plate to define a cavity therebetween, and the front plate defines a front opening formed therethrough; and a rear cover including a rear panel, a top panel, a bottom panel, and a top rail, wherein:

the top panel and the bottom panel extend forwardly from opposing edges of the rear panel, and the top rail extends downwardly from the top panel toward the bottom panel to at least partially define a first top channel configured to slidably maintain an enlarged portion of a sign such that the sign hangs downwardly from the first top channel and extends across the front opening;

wherein the rear cover selectively transitions with respect to the front enclosure between a closed configuration, in which the rear cover extends between the two opposing sidewalls, the top wall, and the bottom wall of the front enclosure to cover the cavity, and an open configuration, in which the rear cover is spaced from the two opposing sidewalls, the top wall, and the bottom wall of the front enclosure.

2. The sign holder assembly of claim 1, further comprising a flexible panel coupling the front enclosure to the rear cover, wherein the flexible panel provides a hinge allowing the rear cover to rotate about the hinge relative to the front enclosure between the open configuration and the closed configuration.

3. The sign holder assembly of claim 1, wherein:

the sign is a first sign, the sign holder assembly includes a second top channel defined between the top rail and the rear panel of the rear cover, and the second top channel is configured to selectively receive a second sign extending substantially parallel to the first sign.

4. The sign holder assembly of claim 1, wherein the rear cover further comprises a first bottom rail extending from the bottom panel toward the top panel and a second bottom rail extending from the bottom panel toward the top panel spaced from the first bottom rail to define a first bottom channel between the first bottom rail and the second bottom rail, the first bottom channel extending substantially coplanar with the first top channel of the top panel and configured to receive a lower edge of the sign.

5. The sign holder assembly of claim 4, wherein the rear cover further comprises:

a third bottom rail extending upwardly from the bottom panel toward the top panel and defining a second bottom channel between the third bottom rail and the second bottom rail;

wherein:

the sign is a first sign, and the top wall defines a first longitudinal slot extending substantially parallel to the front plate and positioned nearer to the front plate of the front enclosure than the top rail is positioned relative to the front plate of the front enclosure, and the first longitudinal slot provides access to the cavity such that a second sign inserted into the first longitudinal slot is positioned to sit within the second bottom channel.

6. The sign holder assembly of claim 4, further comprising the sign, wherein:

the sign is a first sign, the sign holder assembly further comprises a second sign, the top wall of the front enclosure includes a first top wall slot extending adjacent the front panel and a second top wall slot extending adjacent a rear edge of the top wall, the rear cover defines a second bottom channel adjacent the bottom wall and aligned with the first top wall slot, the rear cover defines a third bottom channel adjacent the bottom wall and aligned with the second top wall slot, and the second sign is at least partially maintained by one of the second bottom channel and the third bottom channel following insertion into one of the second bottom channel via the first top wall slot and the third bottom channel via the second top wall slot.

7. The sign holder assembly of claim 1, wherein:

the top wall of the front enclosure includes a rearwardly extending tab, and the front enclosure includes a latch extending downwardly from the rearwardly extending tab to selectively retain the rear panel in the cavity when the sign holder assembly is in the closed configuration.

8. The sign holder assembly of claim 1, further comprising the sign, wherein:

the sign defines edges, and the front enclosure serves as a frame for the sign enclosing the edges of the sign while providing visual access to the sign via the front opening.

9. The sign holder assembly of claim 1, wherein the rear cover includes a pair of substantially L-shaped flanges extending rearwardly from the rear panel and open toward one another to define a track between the pair of substantially L-shaped flanges for receiving a flexible mounting bracket.

10. The sign holder assembly of claim 9, further comprising the flexible mounting bracket, wherein the flexible mounting bracket comprises:

a holder attachment portion slidably received within the track, a shelf attachment portion including a pair of hook flanges open toward one another configured and facing away from the holder attachment portion to be secured to a retail display structure, and a hinge portion extending between the holder attachment portion and the shelf attachment portion in a direction substantially perpendicular relative to the shelf attachment portion, wherein the hinge portion allows the holder attachment portion to be rotated about the hinge portion while the shelf attachment portion remains substantially stationary.

11. The sign holder assembly of claim 10, wherein the flexible mounting bracket includes a spacer projection extending from the shelf attachment portion in a substantially identical direction as the hinge portion extends from the shelf attachment portion such that the holder attachment portion rests on the spacer projection when the hinge portion is substantially linear, and the holder attachment portion is spaced from the spacer projection when the holder attachment portion is rotated about the hinge portion.

12. The sign holder assembly of claim 11, wherein the spacer projection extends from the shelf attachment portion a further distance than the hinge portion extends from the shelf attachment portion such that the spacer projection interacts with holder attachment portion at a desired, substantially non-vertical angle relative to the shelf attachment portion.

13. The sign holder assembly of claim 1, further comprising the sign, wherein:

the sign includes a plurality of pages bound about a spiral binding, the portion of the sign is the spiral binding, and the spiral binding is secured in the first top channel via direct interaction with the top rail such that the pages hang downwardly from the spiral binding.

14. The sign holder assembly of claim 13, wherein the sign is insertable into and removable from the first top channel only by sliding the spiral binding of the sign longitudinally into and out of the first top channel via an end opening of the first top channel.

15. A flexible mount adapter for attaching a frame to a shelf, the flexible mount adapter including:

a stationary plate defining a forward surface and a rear surface opposite the forward surface;

a pair of rearwardly extending rails extending from the rear surface of the stationary plate and being configured to be coupled to the shelf;

a spacer flange extending from the forward surface of the stationary plate to a free end of the spacer flange;

a movable plate disposed in front of the forward surface of the stationary plate and defining a rear surface, wherein the rear surface of the movable plate rests against the free end of the spacer flange when the movable plate is in a first position; and a joint formed between and coupled to each of the stationary plate and the movable plate, wherein the joint allows the movable plate to rotate relative to the stationary plate selectively moving the movable plate from the first position to a second position spaced from the free end of the spacer flange.

16. The flexible mount adapter of claim 15, wherein the spacer flange maintains the movable plate spaced farther from the stationary plate than a portion of the flexible mount adapter positioned opposite the joint when the movable plate is in the first position.

17. The flexible mount adapter of claim 15, wherein:

the movable plate is substantially planar and defines top and bottom edges, the flexible mount adapter is provided in combination with a sign holder defining a back surface and a back track rearwardly extending from the back surface, and the back track is configured to slidably receive the top and bottom edges of the movable plate.

18. A sign holder assembly comprising:

a sign holder including a front enclosure including a front plate, two opposing sidewalls, a top wall, and a bottom wall, wherein:

the two opposing sidewalls, the top wall, and the bottom wall each extend rearwardly from the front plate to define a cavity therebetween, and the front plate defines a front opening formed therethrough;

a rear cover including a rear panel, a top panel, a bottom panel, and a top rail, wherein:

the top panel and the bottom panel extend forwardly from opposing edges of the rear panel, and the top rail extends downwardly from the top panel toward the bottom panel to at least partially define a first top channel configured to slidably maintain an enlarged portion of a sign such that the sign hangs downwardly from the first top channel and extends across the front opening, wherein the rear cover selectively transitions with respect to the front enclosure between a closed configuration, in which the rear cover extends between the two opposing sidewalls, the top wall, and the bottom wall of the front enclosure to cover the cavity, and an open configuration, in which the rear cover is spaced from the two opposing sidewalls, the top wall, and the bottom wall of the front enclosure; and a flexible mount adapter for attaching the sign holder to a shelf, the flexible mount adapter including:

a stationary plate defining a forward surface and a rear surface opposite the forward surface, a pair of rearwardly extending rails extending from the rear surface of the stationary plate and being configured to receive a portion of the shelf, a spacer flange extending from the forward surface of the stationary plate to a free end, a movable plate coupled with the rear cover of the sign holder, disposed in front of the forward surface of the stationary plate, and defining a rear surface, wherein the rear surface of the movable plate rests against the free end of the spacer flange when the movable plate is in a first position, and a joint formed between and coupled to each of the stationary plate and the movable plate, wherein the joint allows the movable plate to rotate relative to the stationary plate selectively moving the movable plate from the first position to a second position spaced from the free end of the spacer flange.

19. A method of displaying information in a retail setting comprising:

opening a two-part frame including separating a rear section of the two-part frame from a front section of the two-part frame by rotating the rear section about a flexible joint relative to the front section;

sliding an enlarged portion of a sign into an elongated retention channel depending from a top panel of the rear section of the two-part frame while the two-part frame remains open such that the sign will hang from the elongated retention channel toward a bottom panel of the rear section opposite the top panel;

rotating the rear section of the two-part frame relative to the front section of the two-part frame along the flexible joint of the two-part frame to close the two-part frame around the sign;

latching the rear section of the two-part frame within the front section of the two-part frame to maintain the two-part frame in a closed position;

wherein the front section of the two-part frame includes a front opening providing visual access to the sign while the sign is hung from the rear section of the two-part frame and the two-part frame is in the closed position.

20. The method of claim 19, wherein the sign is provided in the form of a spiral bound plurality of pages, the enlarged portion of the sign is a spiral binding of the sign, and sliding the enlarged portion of the sign into the elongated retention channel results in the sign being secured to the rear section via interaction between the spiral binding and rails of the rear section defining the elongated retention channel such that the spiral bound plurality of pages of the sign hang from the spiral binding of the sign.

21. The method of claim 19, wherein:

the sign is a first sign, and the method further comprises inserting a second sign into the two-part frame through an elongated slot formed through a top wall of the front section of the two-part frame such that the second sign is retained between opposing channels defined by the two-part frame within a cavity defined by the front section, the second sign extending substantially parallel to and covering the first sign from view through the front opening.

22. The method of claim 19, further comprising:

sliding a bracket into tracks extending from a rear surface of the rear section of the two-part frame; and slidably coupling a section of the bracket opposite the two-part frame to a front extension of a product display shelf.

23. The method of claim 22, wherein:

the bracket includes a living hinge extending substantially in parallel to a front edge of the product display shelf, and the method further comprises rotating the two-part frame relative to the front edge of the product display shelf about the living hinge of the bracket.

24. The method of claim 20, further comprising:

re-opening the two-part frame;

sliding the spiral binding of the sign out of the elongated retention channel;

flipping one or more of the plurality of pages of the sign about the spiral binding to change which one of the one or more of the plurality of pages is a front most page;

replacing the sign into the two-part frame by sliding the spiral binding back into the elongated retention channel after flipping the one or more of the plurality of pages; and returning the two-part frame to the closed configuration.

* * * * *